United States Patent [19]

Erickson et al.

[11] 4,244,139

[45] Jan. 13, 1981

[54] EATING DOLL

[75] Inventors: Erick E. Erickson, Chicago; Wayne A. Kuna, Oak Park, both of Ill.

[73] Assignee: Marvin Glass & Associates, Chicago, Ill.

[21] Appl. No.: 117,437

[22] Filed: Feb. 1, 1980

[51] Int. Cl.[3] ..... A63H 13/02

[52] U.S. Cl. ..... 46/141; 46/135 R

[58] Field of Search ..... 46/141, 135 R, 154, 46/171, 119, 264

[56] References Cited

U.S. PATENT DOCUMENTS

| | | | |
|---|---|---|---|
| 1,440,487 | 1/1923 | Newell | 46/135 R |
| 2,688,208 | 9/1954 | Bannister | 46/171 X |
| 2,856,729 | 10/1958 | Clintsman | 46/135 R |
| 3,005,283 | 10/1961 | Cohn | 46/141 X |
| 3,153,881 | 10/1964 | Baulard-Cogan | 46/135 R X |
| 3,186,126 | 6/1965 | Ostrander | 46/171 X |
| 3,195,269 | 7/1965 | Weih et al. | 46/135 R |
| 3,234,688 | 2/1966 | Neumann et al. | 46/135 R |
| 3,261,124 | 7/1966 | Bodenstein | 46/135 R X |
| 3,924,351 | 12/1975 | Terzian | 46/135 R X |

FOREIGN PATENT DOCUMENTS

| | | | |
|---|---|---|---|
| 1027624 | 5/1953 | France | 46/135 R |

*Primary Examiner*—Gene Mancene
*Assistant Examiner*—Mickey Yu
*Attorney, Agent, or Firm*—Mason, Kolehmainen, Rathburn & Wyss

[57] ABSTRACT

An animated doll includes a hollow head and body formed with a wall of thin flexible material and having a face with a forward side with a mouth cavity defined therein including movable upper and lower lips. The mouth cavity is adapted to hold a quantity of food and includes a wall portion which is deflectable to expel food from the mouth between the lips simulating the action of a young child learning to eat solid food. The doll includes a first operator for moving the lips to open and close to animate chewing and a second operator for moving the inside wall of the mouth outwardly between the lips to eject or spit out food with an outward tongue thrust.

15 Claims, 6 Drawing Figures

EATING DOLL

BACKGROUND OF THE INVENTION

1. Field of the Invention

The present invention relates to animated dolls and more particularly relates to an animated doll which is capable of closely simulating the action of a young baby or infant when first learning to eat solid type foods.

2. Description of the Prior Art

A wide variety of animated dolls have been developed which have simulated real life actions such as walking, talking, crying, etc. As far as is known, no dolls have been developed having the capability of simulating a young child or infant when learning to eat solid food including the movement of the lips as in chewing and subsequently ejecting or spitting out the food with a tongue thrust type action.

OBJECTS OF THE PRESENT INVENTION

It is an object of the invention to provide a new and improved animated doll and more particularly, an animated doll which is operable to closely simulate the action of a young baby or infant in chewing food and subsequently ejecting or spitting out the food with a tongue thrust action.

It is another object of the present invention to provide a new and improved animated doll of the character described which is operable to provide movement of the lips simulating the action of chewing food.

Another object of the present invention is to provide a new and improved baby doll of the character described which is capable of holding a quantity of food in a mouth cavity and subsequently ejecting or spitting out the food with an action resembling the outward thrust of a tongue between the lips.

Still another object of the present invention is to provide a new and improved animated doll of the character described which is operable in sequence to first simulate a young child in the act of chewing food placed in the mouth and subsequently spitting out or ejecting the food.

Still another object of the present invention is to provide a new and improved animated doll which is operable to simulate both the chewing of food and the spitting out of food.

SUMMARY OF THE INVENTION

The foregoing and other objects and advantages of the present invention are accomplished in an illustrated embodiment by way of demonstration and not limitation which includes an animated doll having a hollow head and body formed with a wall of thin flexible material. The head of the doll is formed with a face on a forward side having a mouth defined therein including movable upper and lower lips and an internally extending mouth cavity having a deflectable back wall which is movable forwardly and outwardly between the lips to simulate the forward thrust of the tongue between the lips. The doll includes a first operator for moving the lips to open and close as in chewing food and a second operating element for thereafter moving the internal wall of the mouth outwardly between the lips as a tongue is used to spit out or eject the food in the mouth.

BRIEF DESCRIPTION OF THE DRAWINGS

For a better understanding of the invention, reference should be had to the following detailed description taken in conjunction with the drawings, in which.

DESCRIPTION OF THE PREFERRED EMBODIMENT

Figure 1:
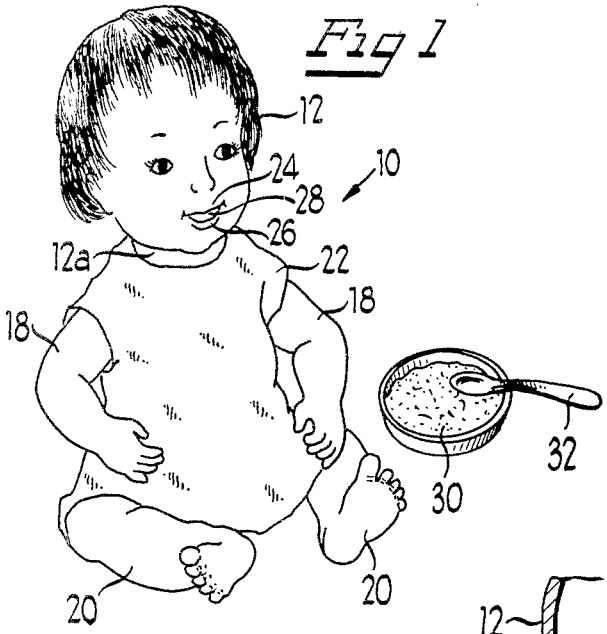
FIG. 1 is a front perspective view of a new and improved animated doll constructed in accordance with the features of the present invention and shown in an upright sitting position with an adjacent dish of food ready to be eaten.
Figure 5:
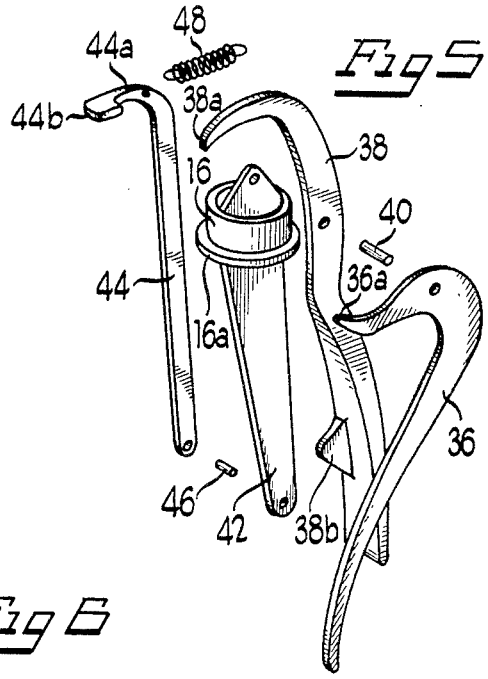
FIG. 5 is an exploded, perspective view illustrating internal operating mechanisms of the doll.

Referring now more particularly to the drawings, therein is illustrated a new and improved animated doll constructed in accordance with the features of the present invention and referred to generally by the reference numeral 10. The doll 10 includes a hollow head 12 formed with a wall or other skin of thin, flexible, plastic material and terminating in a downwardly extending, generally cylindrical, neck 12*a*. The doll also includes a hollow body or abdomen of similar construction referred to by the reference numeral 14 and formed with a cylindrical opening 14*a* at the upper end having an internal groove 15 which is seated on an annular flange 16*a* at the lower end of a generally cylindrical internal neck or base structure 16 formed of rigid material such as molded plastic resin or the like. The doll is provided with a pair of arms 18 and a pair of legs 20 extending outwardly from the abdomen or body 14 and may also be provided with an outer garment 22 of the type usually worn by young children or infants.

In accordance with the present invention, the doll's head 12 is formed with a facial contour on the front or forward side having the customary facial features and including a pair of upper and lower lips 24 and 26 which are integral with the facial wall and are flexible to move toward and away from each other to simulate the action of eating and chewing of food. The flexible lips 24 and 26 form the outer extremity of an internally extending, hollow mouth cavity 28 having a continuous wall and which is large enough when the mouth is open as shown in FIG. 2 in order to receive food such as cereal 30 which may be placed in the doll's open mouth with a spoon or other implement 32 during play.

Figure 6:
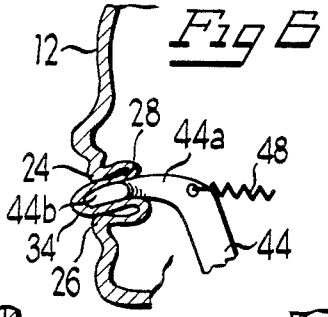
FIG. 6 is a fragmentary, vertical, cross-sectional view similar to FIG. 2, but showing the mouth of the doll in a different operative position for ejecting or spitting out food.

On an upper back wall portion of the mouth cavity 28 there is provided a small, outwardly, concave section 34 which is colored appropriately and which forms a tongue as shown in FIG. 6 when the wall is deflected and forced outwardly between the upper and lower lips 24 and 26 as illustrated.

Figure 2:
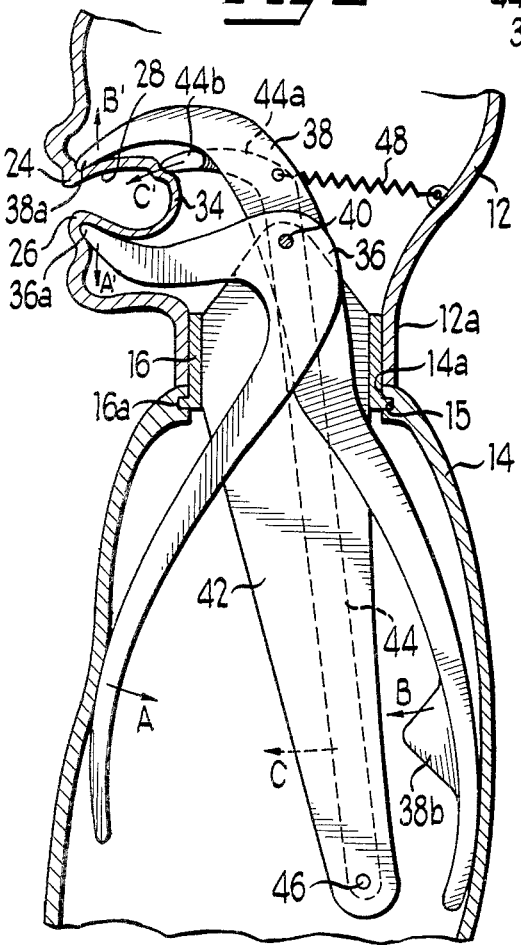
FIG. 2 is a fragmentary, substantially vertical, sectional view taken through the mid portion of the doll of FIG. 1.
Figure 3:
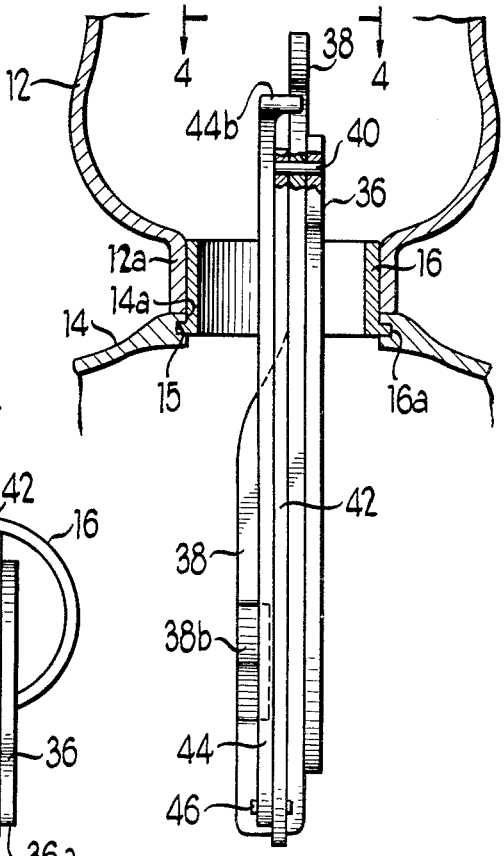
FIG. 3 is a fragmentary, vertical, cross-sectional view similar to FIG. 2, but taken on a plane at right angles thereto.
Figure 4:
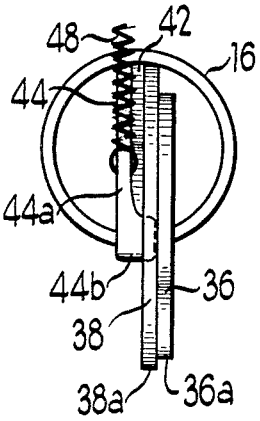
FIG. 4 is a fragmentary, horizontal, cross-sectional view looking substantially in the direction of arrows 4—4 of FIG. 3.

The doll 10 is provided with a first operator mechanism resembling a pair of pliers and including elongated lever elements 36 and 38 which are pivotally interconnected adjacent upper portions thereof on a pivot pin 40 extending laterally between opposite sides of the face in the doll's head behind the mouth 28, as shown in FIGS. 2 and 3. The pivot pin 40 is supported adjacent the apex of a triangular-shaped, upper end portion of an elongated, vertically extending base structure 42 which is integrally joined with the collar or neck 16 on a diametrical plane thereof generally bisecting the head and abdomen of the doll.

Each of the lever elements 36 and 38 includes a relatively long, downwardly depending handle portion curved outwardly toward an adjacent inside surface on the front and back wall of the hollow abdomen or body 14. At the upper end, the element 36 is formed with a relatively short, horizontally extending leg having an upsloping, forwardly projecting tip or outer end **36*a* adapted to engage the inside surface of the lower lip 26 for moving the lip downwardly away from the opposite upper lip 24 (arrow "A'") when a lower portion of the element 36 is pressed inwardly in the direction of the arrow "A" (FIG. 2). The lever element 38 also includes a generally horizontally extending, relatively short, upper segment having an outwardly and downwardly sloping outer end portion with a tip 38*a* adapted to engage and move the upper lip 24 upwardly away from the lower lip 26 (arrow "B'") when the lower end portion of the lever element is moved inwardly by pressure on the doll's body at the back as indicated by the arrow "B" in FIG. 2. Simultaneous inward squeezing pressure on the lower handle portions of the lever elements 36 and 38 results in the lips moving apart from one another and when pressure is released, the flexible walls of the lips return the lever elements toward the original position as shown in FIG. 2 with the lower handle portions engaging the inside surfaces of the adjacent front and back walls of the body 14**.

Squeezing and release of the body 14 results in a chewing type action as the lips move toward and away from one another to open and close the mouth cavity 28. In addition, either of the lever elements 36 or 38 may be moved independently of the other so that only one of the lips 24 or 26 will move relative to the other as desired. It will thus be seen that pivotal movements of plier-like lever elements 36 and 38 results in an eating or chewing type action. The amount of travel or movement of the tips at the outer end portions **36*a* and 38*a*, respectively, is relatively small in comparison to the amount of displacement of the lower end or handle portion of the elements in the doll's body 14 and this results in a limited amount of lip travel. Because of the difference in distances between the outer tips 36*a* and 38*a* and the pivot axis 40 on the one hand, and between the pivot axis and the lower end portions or handle segments of the plier elements where inward pressure is applied on the other hand, the lips move over a relatively small distance in comparison to the amount of squeezing action on the body 14**.

In accordance with the invention, the doll also includes a second operating mechanism in the form of an L-shaped member 44 having a relatively long lower end portion mounted for pivotal movement on a pivot pin 46 adjacent the lower end at the lower end of the base 42. At the upper end, the L-shaped element 44 is formed with a relatively short, generally horizontally extending leg **44*a* having a flattened outer end portion or tip 44*b* in the shape of a tongue and adapted to engage the inside surface of the tongue forming wall segment 34 in the mouth cavity wall. The operator element 44 is biased toward the rear of the head by an elongated, coil spring 48 and is movable in opposition against the spring by pressure applied to a lower leg of the element by a triangular-shaped, integral lug 38*b* on the inside surface of the depending handle portion of the lever element 38. After the lever element is depressed inwardly in the direction of arrow "B" for a selected distance, the apex of the lug 38*b* engages the rear edge of the tongue operator element 44 causing the element to pivot in a counterclockwise direction as indicated by the arrow "C". Because the point of engagement between the lug 38*b* and the lower leg of the tongue operator 44 is relatively close to the lower pivot pin 46 in comparison to the distance between the tongue forming tip 44*b* and the pivot pin, a small amount of inward movement of the lug 38*a* after engagement causes a much greater amount of movement or travel of the short leg 44*a* as indicated by the arrow "C'". After the lug 38*b* has initially come into contact or engaged, the tongue actuator 44 further inward depression of the lever element 38 results in rapid outward movement or "tongue thrust" of the wall 34 in the mouth cavity 28 and when the outer end of the tongue forming tip 44*b* is spaced outwardly between the upper and lower lips 24 and 26 as illustrated in FIG. 6, any food in the mouth has been ejected or "spit out". As the rear wall of the cavity is folded around the upper leg 44*a* of the tongue operator 44, the tongue-like element is formed and any food 30 that is present in the mouth cavity 28** is forcefully ejected or "spit out", to closely simulate the action of a young baby when first learning to chew solid foods.

When the inward pressure on the plier element 38 is released, the bias spring 48 and the pressure of the mouth wall 28 tending to return to the condition of FIG. 2 is effective to return the tongue actuator 44 back to the position shown, and the mouth is open and ready to receive more food. It will also be seen that whenever inward pressure on the back or front wall of the doll's abdomen is released, the upper and lower lips 24 and 26 will move toward one another whereas when increased inward pressure is applied on the doll's body, the lips will move away from one another as indicated by the relative short arrows "A'" and "B'". After enough inward pressure has been exerted on the handle portion of the plier element 38 to cause the lug **38*b* to engage the tongue actuator 44, any further inward movement of the element 38 will cause the tongue to form and thrust outwardly while at the same time, only a small amount of movement of the lips 24 and 26** will occur. The relatively large movement of the tongue thrust in comparison to a small amount of lip movement closely simulates the real life action of a young child learning to eat solid food.

When only a limited amount of inward pressure is applied on the lower end handle portions of the plier elements 36 and 38 without contact between the lug **38*b* and operator 44**, the doll will be activated to provide only a "chewing" or "eating" action and no tongue formation or tongue thrust will occur.

From the foregoing it will be seen that the baby doll 10 constructed in accordance with the features of the present invention closely simulates the lip and tongue movements of a young child or infant learning to eat solid food. The doll is selectively controllable to provide for chewing action alone or may also provide tongue thrust action to simulate the spitting out of food when desired.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. An animated doll including a hollow head and body formed with a wall of thin plastic material;

said head having a face on a forward side with a mouth defined therein including movable upper and lower lips for opening and closing said mouth, said mouth including a cavity adapted for holding food formed to normally extend inwardly of said lips and including a flexible inside wall portion movable outwardly and inwardly between said lips;

first mechanical operator means for moving at least one of said lips toward open and closed positions, and second mechanical operator means for moving said inside wall portion of said mouth inwardly and outwardly between said lips for receiving and ejecting food placed in said cavity, said second operator means including an elongated element having a rigid free end portion engaging said flexible inside wall portion of said mouth to form a tongue-like projection movable outwardly between said lips.

2. The animated doll of claim 1 wherein said first operator means includes a pair of pivotally interconnected members, at least one of said members having an upper portion engaging one of said lips on an inside surface of said wall of said hollow head and a depending handle portion extending downwardly into said hollow body and manually depressible inwardly thereof to move said mouth toward said open position.

3. The animated doll of claim 2 wherein said members are pivotally interconnected about a pivot axis spaced inwardly of said mouth extending transversely of said head between opposite sides of said face.

4. The animated doll of claim 1 wherein said second operator means includes a lower body portion extending downwardly of said free end into said hollow body and movable inwardly thereof to actuate said free end to move said inside wall portion outwardly between said lips.

5. The animated doll of claim 4 wherein said rigid free end of said second operator means includes an elongated element movable longitudinally between said lips.

6. The animated doll of claim 5 wherein said lips are movable toward and away from a path of movement of said rigid free end elongated element generally transversely thereof.

7. The animated doll of claim 6 wherein said first and second operator means include elongated body elements extending downwardly into said body and at least one of which is movable inwardly of said body for opening at least one of said lips and extending said inside wall portion of said mouth outwardly between said lips.

8. The animated doll of claim 7 wherein said first operator means includes a pair of said body elements pivotally interconnected and at least one of said body elements of said first operator means positioned adjacent a back wall portion of said hollow body for inward depression thereof.

9. The animated doll of claim 8 wherein said body element of said second operator means is positioned adjacent said one of said body elements of said first operator means for engagement thereby to move said inside wall portion of said mouth outwardly between said lips after one of said lips is moved toward opening said mouth.

10. The animated doll of claim 9 wherein at least one of said body elements of said first operator means is pivotable about a first axis spaced inwardly of said mouth transversely of said head and said body element of said second operator means is pivotable about a second axis spaced from said first axis.

11. The animated doll of claim 10 wherein said second axis is parallel of said first axis and is spaced farther away from said mouth in said body.

12. The animated doll of claim 5 wherein said free end of said second operator means is shaped like a tongue and said inside wall portion of said mouth is deflected by said tongue shaped free end to appear as a tongue when extended outwardly between said lips.

13. The animated doll of claim 7 wherein the other of said body elements of said first operator means comprises a base internally of said doll for supporting said one body element of said first operator means.

14. The animated doll of claim 13 wherein said pair of said body elements of said first operator means is pivotally interconnected by axle means remote from said mouth.

15. The animated doll of claim 14 wherein said body element of said second operator means is supported for pivotal movement on axle means mounted on said base remote from said first mentioned axle means of said first operator means.

* * * * *